United States Patent [19]

Whittington

[11] Patent Number: 4,479,531

[45] **Date of Patent: * Oct. 30, 1984**

[54] ELECTROMAGNETIC STIRRING

[75] Inventor: Keith R. Whittington, Great Shelford, England

[73] Assignee: TI (Group Services) Limited, Birmingham, England

[ * ] Notice: The portion of the term of this patent subsequent to Sep. 11, 2001 has been disclaimed.

[21] Appl. No.: 530,617

[22] Filed: Sep. 9, 1983

Related U.S. Application Data

[63] Continuation of Ser. No. 296,496, Jun. 1, 1981, abandoned.

[30] Foreign Application Priority Data

Jun. 5, 1980 [GB] United Kingdom ..... 8018372

[51] Int. Cl.[3] ..... B22D 27/02

[52] U.S. Cl. ..... 164/504; 164/468

[58] Field of Search ..... 164/468, 504, 499, 147.1; 266/233, 234

[56] References Cited

U.S. PATENT DOCUMENTS

| | | | |
|---|---|---|---|
| 2,861,302 | 11/1958 | Mann et al. | 164/504 |
| 3,610,973 | 10/1971 | Bauer | 310/15 |
| 4,137,961 | 2/1979 | Mola | 164/468 |
| 4,200,141 | 4/1980 | Delassus | 164/504 |
| 4,294,304 | 10/1981 | Delassus | 164/504 |

FOREIGN PATENT DOCUMENTS

| | | | |
|---|---|---|---|
| 185518 | 5/1956 | Fed. Rep. of Germany | 164/504 |
| 55-40004 | 3/1980 | Japan | 164/504 |
| 55-54245 | 4/1980 | Japan | 164/504 |

*Primary Examiner*—Kuang Y. Lin

*Attorney, Agent, or Firm*—Kemon & Estabrook

[57] ABSTRACT

An apparatus for stirring a molten metal in an open topped mould, in for example a continuous casting process, includes a series of electrical conductors which are positioned above the top of the mould and about the vertical axis thereof. Each of these conductors are connected to a different phase of a multi-phase alternating current supply, so that the currents flowing in the conductors will create a magnetic field which rotates about the vertical axis of the mould and penetrates down into the mould. Ferromagnetic pole pieces are associated with the conductors to provide a low reluctance flux path, which will reduce leakage of the magnetic field above the conductors and concentrate the field below the conductors where it penetrates down into the mould.

17 Claims, 5 Drawing Figures

Figure 1:
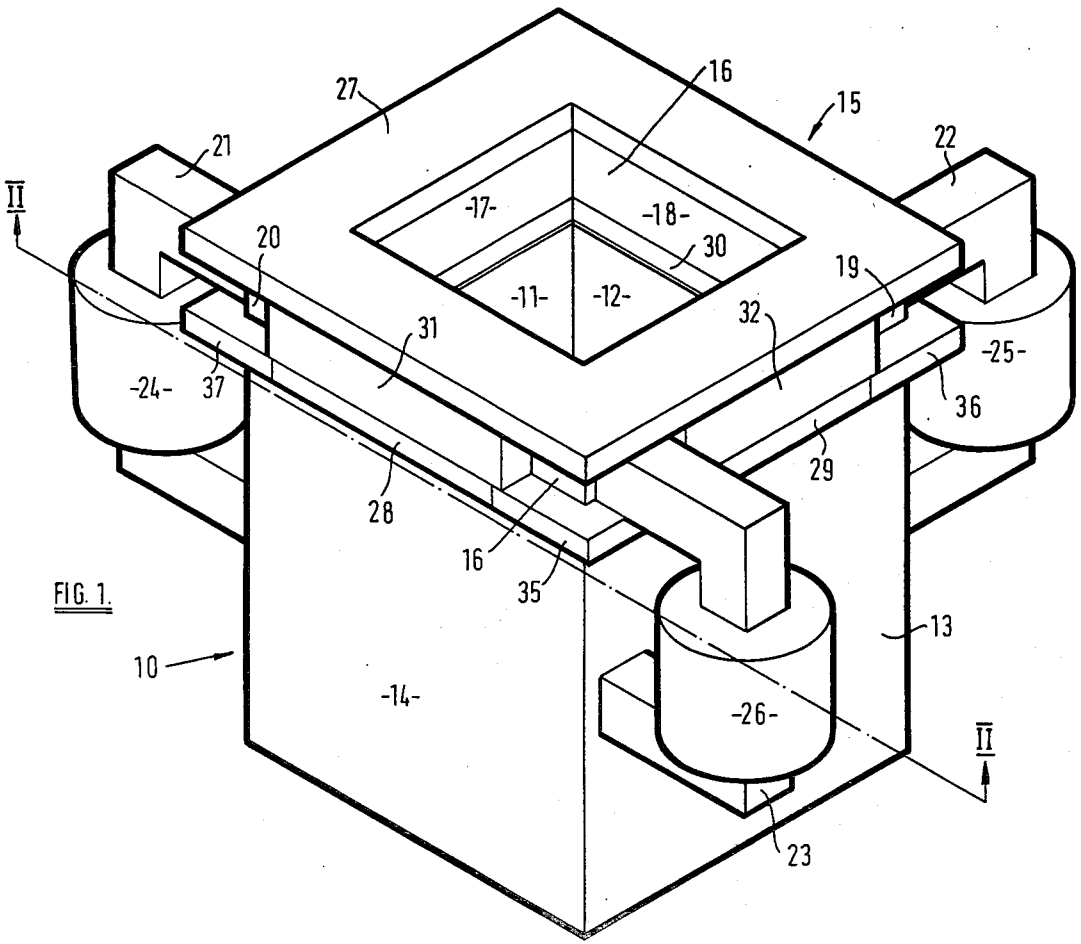

FIG. 2.
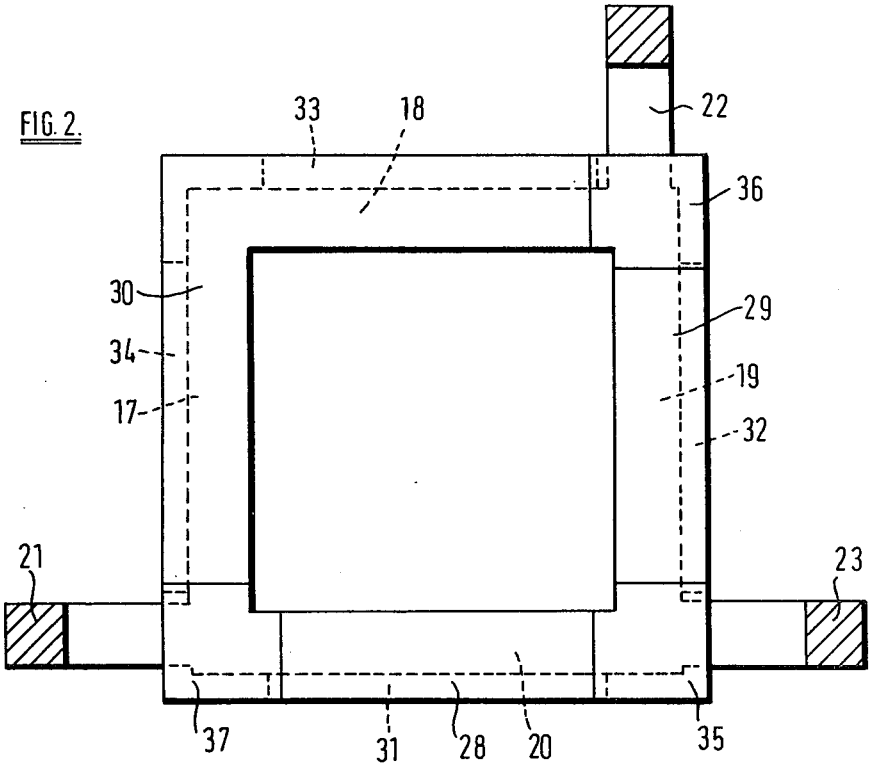
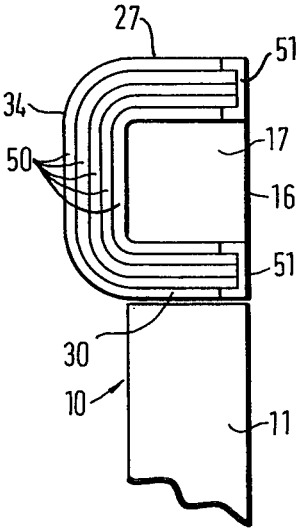
FIG. 4.

ELECTROMAGNETIC STIRRING

This application is a continuation of application Ser. No. 296,496, filed June 1, 1981 abandoned.

This invention relates to the stirring of molten metals.

When casting metals, for example steel by a continuous casting process, molten steel is poured into a water-cooled /copper mould which defines the cross-sectional shape of the section to be cast, which then emerges from the bottom of the mould as a continuous strand. As the molten steel contacts the mould, it solidifies to form a skin which gradually thickens as the strand passes through the mould, until at the lower end of the mould, a wall has been built up of sufficient thickness to contain the core of the strand which is still molten. After the strand leaves the mould it is normally further cooled by jets of water, so that the core gradually cools and solidifies from its outer surface, until the whole of the strand has solidified.

If the steel is allowed to solidify under normal conditions, an inhomogeneous structure is formed in which impurities are distributed non-randomly throughout the strand and also the crystal structure of the strand varies between the outer regions, which during the solidification process are subject to high temperature gradients, and the inner regions which are subjected to relatively low temperature gradients.

In order to achieve a homogeneous structure, it is desirable to agitate the molten metal throughout the casting process. It is known to stir the molten metal in the core of the strand, by means of electromagnetic transducers placed around the strand as it emerges from the mould.

However, in general these methods do not adequately stir the metal in the region of the mould and sections produced in this manner have a discontinuity, sometimes termed "white-band", close to the surface. It is desirable therefore that some form of stirring is provided in the mould region itself. Attempts have been made to provide such stirring, by placing electromagnetic transducers around the mould. To date however it has proved difficult to achieve adequate stirring within the mould. The main reason for this is the high electrical conductivity of the copper mould, which significantly attenuates the magnetic field, but also difficulties arise in the positioning of the transducers around the mould, as for the greatest effect they must be placed within the water cooling jacket of the mould.

In our copending Ser. No. 269,495 patent application No. (British Patent Application No. 8018372) we disclose an apparatus for stirring a molten metal in an open topped mould comprising, an electromagnetic transducer formed from a series of electrical conductors which are capable of carrying a high current, these conductors being spaced above the mould around its vertical axis and each of said conductors being connected to a different phase of a multi-phase alternating current supply, the sequence of the conductors being the same as the sequence of the phases, so that the currents passing through the conductors will produce a magnetic field which rotates about the vertical axis of the mould and penetrates down into the mould.

With this form of stirrer the magnetic field is formed symetrically above and below the conductors and consequently as the molten metal in the mould is stirred by the field below the conductors only, a significant portion of the field produced by the conductors is not utilised.

According to one aspect of the present invention an apparatus for stirring molten metal in an open topped mould comprises an electromagnetic transducer, formed from a series of electrical conductors which are capable of carrying a high current, these conductors being spaced above the mould around its vertical axis and each of said conductors being connected to a different phase of a multi-phase alternating current supply, the sequence of the conductors being the same as the sequence of the phases, so that the currents passing through the conductors will produce a magnetic field, ferromagnetic pole pieces being associated with the conductors to provide a low reluctance flux path which will reduce leakage of the magnetic field above the conductors and concentrate the field below the conductors.

Preferably the electrical conductors are made from non-ferromagnetic electrically conductive bars, for example copper bars, in the form of closed loops. High currents are induced in these loops by means of energising coils which may either be wound about the conductor, or may be coupled thereto by ferromagnetic cores. Conveniently these loops are formed by a pair of coaxial rings which are connected together by a plurality of links, the energising coils being mounted on these links. The coaxial rings may be coplanar, but they are preferably positioned one above the other, in which case the lower ring may conveniently be formed by the mould itself. With this form of transducer, the ferromagnetic pole pieces may be positioned about the top, outer and bottom edges of the conductors, the edge of the conductors directed towards the vertical axis of the mould being left clear. Where the coaxial ring construction is utilised, only the upper or inner ring need be provided with pole pieces.

As the magnetic field produced by the transducer penetrates into the molten metal in the mould, through the open top of the mould and not through the walls of the mould, there is comparatively little attenuation of the magnetic field and normal mains frequencies of 50 to 60 Hz may consequently be used, rather than the lower frequencies which have been required with stirrers positioned around the mould. Typically, the electromagnetic transducer will be designed so that when each of the energising coils is connected to a different phase of a three-phase alternating current mains supply, a current in excess of 10,000 L amps at a voltage drop of about 1 or 2 volts and frequency of 50 to 60 Hz, will be induced in the conductors.

Figure 3:
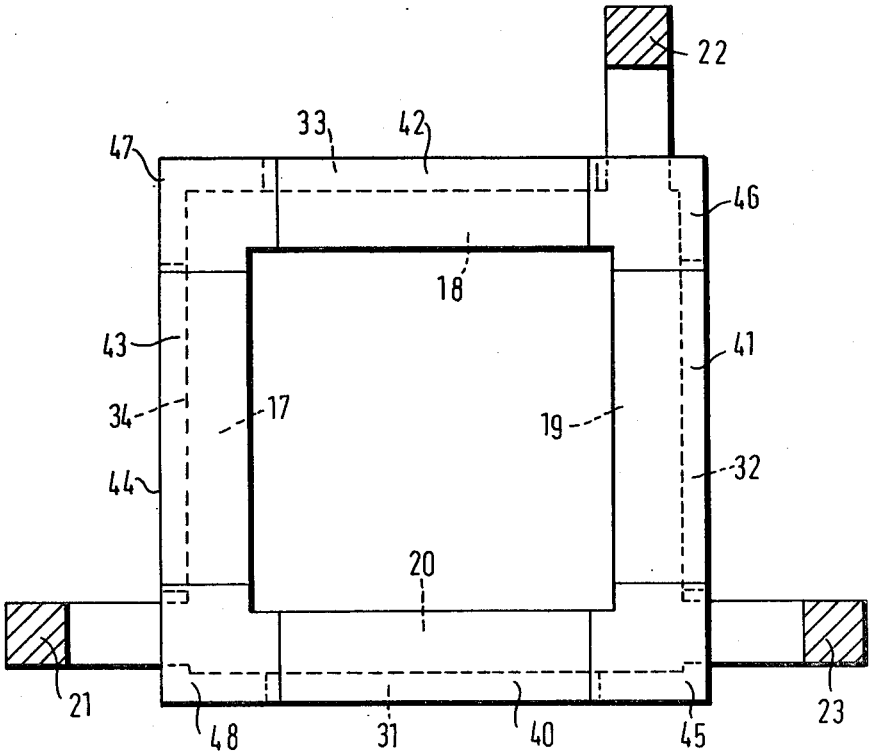
Figure 5:
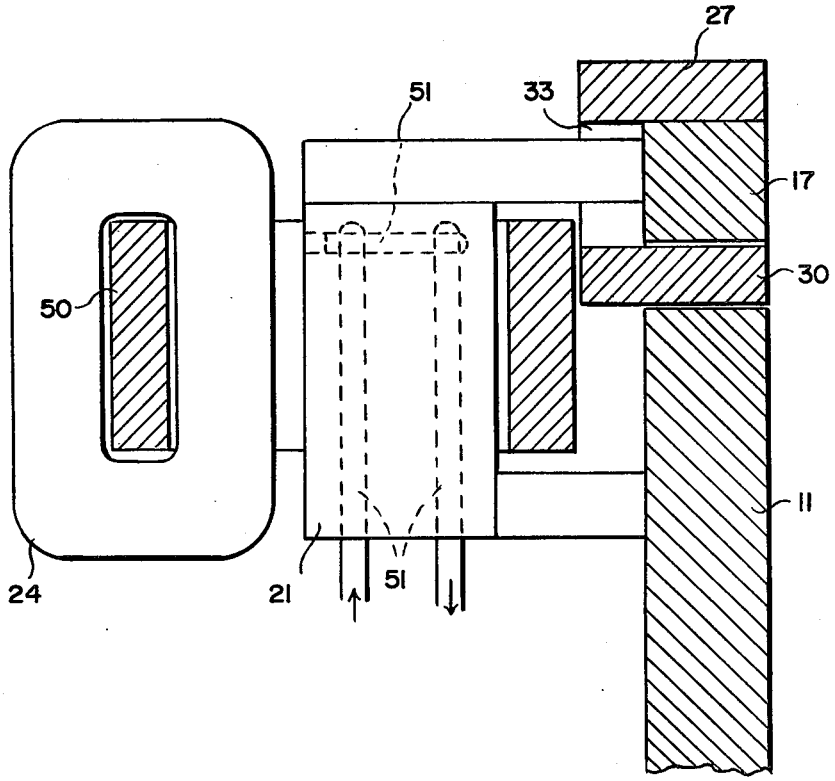

Various embodiments of the present invention are now described, by way of example only, with reference to the accompanying drawings, in which FIG. 1; illustrates an apparatus for the continuous casting of metals, incorporating an electromagnetic stirrer in accordance with the present invention;

FIG. 2; shows a cross-sectional view of the apparatus illustrated in FIG. 1, along the line II—II;

FIG. 3; shows a similar view to FIG. 2, of a modified form of stirring apparatus;

FIG. 4; shows a part-sectional view of a further modified form of the mould/stirrer shown in FIG. 1; and FIG. 5 shows an alternative method of coupling the energizing coils to the conductors.

As illustrated in FIG. 1, an apparatus for the continuous casting of metals, includes a mould 10 defined by four copper walls 11 to 14 which are normally surrounded by a jacket, so that the mould 10 can be water cooled.

Molten metal is poured into the top of the mould 10 where, upon contact with the cooled wall 11 to 14 of the mould 10, it solidifies gradually to form a skin. This skin gradually thickens as the metal passes through mould 10, until it emerges as a strand from the bottom of the mould 10. While the strand is not fully solidified by the time it emerges from the mould, the skin that has built up is of sufficient thickness to retain the molten core, which eventually solidifies to form a solid strand.

The mould 10 is provided with an electromagnetic stirrer 15 which is positioned above the open top of the mould 10 and creates a magnetic field which rotates about the vertical axis of the mould 10 and penetrates down into the mould 10 in order to stir the molten metal within the mould 10. This stirring motion causes the lighter impurities in the molten metal to be centrifuged towards the centre of the mould and also encourages the formation of a uniform crystaline structure within the mould 10.

The electromagnetic stirrer 15 comprises a ring 16 of the same cross-section as the periphery of the mould 10 and is co-axial with and spaced above the mould 10. The sides 17 to 20 of the ring 16 are made of stout copper bars of square section. Sides 17,18 and 19 of the ring 16 are connected to the adjacent walls 11,12, and 13 of the mould 10 by means of copper links 21,22 and 23. Toroidal energizing coils 24,25 and 26 are wound about the links 21,22 and 23 and each of these coils 24,25 and 26 is connected to a different phase of a three-phase alternating current mains supply, the sequence of the coils 24,25,26 being the same as the sequence of the phases.

This construction forms a series of three closed loops, the first defined by walls 11 and 12 of the mould 10, link 22, sides 18 and 17 of ring 16 and link 21; the second defined by wall 13 of mould 10, link 23, side 19 of ring 16 and link 22; and the third defined by wall 14 of mould 10, link 23, side 20 of ring 16 and link 21. Each of the loops is energised by two of the energising coils 24,25 and 26, the first loop by coils 24 and 25 the second by coils 25 and 26 and the third by coils 26 and 24. Currents are induced in the loops by these energising coils 24,25 and 26 so as to produce a magnetic field which rotates around the vertical axis of the mould 10 and penetrates down into the molten metal within the mould 10. The rotating field produced by the electromagnetic stirrer 15 induces eddy currents in the molten metal within the mould 10, which in turn produce magnetic fields which interact with the rotating magnetic field. This interaction of magnetic fields causes the molten metal in the mould 10 to rotate around the vertical axis of the mould 10.

A common pole piece in the form of a ring 27, made of ferromagnetic material is mounted upon the upper surface of ring 16 and three other pole pieces 28,29,30 made of ferromagnetic material, are mounted on the lower surface of ring 16, between ring 16 and the top of the mould 10. The pole pieces 28,29 and 30 are connected to ring 27 by ferromagnetic plates 31 to 34 which lie against the outer surfaces of the ring 16. As illustrated in FIG. 2, the three pole pieces 28,29 and 30 may be fabricated into a single plate, the gaps between the pole pieces 28,29,30 being filled by inserts 35,36,37 these inserts 35,36 and 37 being made of a non-ferromagnetic material, for example stainless steel.

By this means a continuous surface is provided on the inner surface of the stirrer, which prevents splashes of molten metal becoming trapped in the gaps which would otherwise be left between the pole pieces 28,29 and 30. Also for this purpose, any gaps between the ring 27, ring 16, pole pieces 28,29,30 and the top of the mould 10, should also be filled.

The ferromagnetic ring 27, pole pieces 28,29,30 and plates 31 to 34, provide a low reluctance flux path which will reduce leakage of the magnetic field above the top of the ring 16 and will concentrate the magnetic field below the ring 16. The arrangement of pole pieces 28,29,30 also causes the field to penetrate to a greater extent into the mould 10. Using this modification, improvements of the order of 50% increase in the penetration of the field into the mould 10, have been achieved.

While the electromagnetic stirrer 15 described above, comprises a series of three loops, it is found that the efficiency of the stirrer is improved by adopting a symetrical arrangement of pole pieces 40 to 43 between the copper ring 16 and the top of the mould 10. These pole pieces 40–43 may again be fabricated into a continuous ring 44, non-ferromagnetic inserts 45–48 being inserted between the pole pieces 40 to 43 as illustrated in FIG. 3.

The effect of the ferromagnetic pole pieces may also be improved by making these and the ferromagnetic connecting plates 31 to 34 of laminated construction, as illustrated in FIG. 4. The exposed edges of the plies 50 of these laminated pole pieces may be protected from splashes of molten metal, by means of channel shaped cover plates 51, which are made of non-ferromagnetic material, for example stainless steel.

In the embodiments described above, the energising coils, 24,25,26 are wound about the copper links, 21,22,23. These links are however heated by the radiant heat from the molten metal and also by the high currents flowing through the links 21,22,23 and consequently there is a danger that the energising coils 24,25, 26 may be damaged by excessive heat. This danger may be overcome by coupling helical energising coils to the links 21,22,23 by means of ferromagnetic cores 50, as illustrated in FIG. 5. These cores may advantageously be of multi-ply construction. An alternative or additional way of avoiding damage to the energising coils 24,25,26, is to cool either the links 21,22,23 or the energising coils 24,25,26 themselves. One method of doing this is to provide ducts 51, as illustrated in FIG. 5, in the links 21,22,23, through which ducts a coolant, for example water may be circulated.

While the present invention has been described in relation to the continuous casting of metals, it may be used generally to stir molten metal in any type of mould. Furthermore, while the transducers described are particularly useful for stirring molten metals in open containers with walls formed from materials of high electrical conductivity, which would significantly attenuate a magnetic field passing therethrough, they may also be used to stir molten metals in open or closed containers made of materials of low or non-electrical conductivity.

Various modifications may be made to the embodiment described above without departing from the invention. For example, in any of the embodiments where the energising coils are described as being wound about the copper conductors, it is necessary to provide adequate insulation and also the coils are preferably wound onto an appropriately shaped ferromagnetic core.

I claim:

1. An apparatus for stirring molten metal in an open topped mold comprising: a series of three or more conductors in the form of closed loops made from bars of non-ferromagnetic electrically conductive material, these loops being positioned around the vertical axis of the mold so that a portion of each loop forms one of a ring of conductive elements surrounding the vertical axis of the mold and positioned above the mold; each of the loops being coupled inductively via an energizing coil to a different phase of a multi-phase alternating current supply, the sequence of the loops being the same as the sequence of the phases, so that currents induced in the loops will produce a magnetic field above the mold, said magnetic field penetrating down into the mold and rotating about the vertical axis of the mold, said energizing coils being located outside the flux path of the magnetic field into the mold; ferromagnetic pole pieces being associated with the loops to provide a low reluctance flux path which will reduce leakage of the magnetic field above the conductors and concentrate the field below the conductors.

2. An apparatus according to claim 1 in which a single common ferromagnetic pole piece, associated with all the conductors of the transducer, is positioned above the conductors; and a series of individual pole pieces, each associated with the different one of the conductors, are positioned below the conductors; this series of individual pole pieces being connected to the common pole piece by means of ferromagnetic plates which are positioned adjacent to the outer edge of the conductors.

3. An apparatus as in claim 1 in which the series of conductors provided by a pair of co-axial rings interconnected by at least three links, each link being coupled to an energising coil.

4. An apparatus as in claim 3 which the two rings are positioned one above the other and the individual pole pieces are positioned between the two rings.

5. An apparatus as in claim 4 in which the lower ring is formed by the walls of the mould.

6. An apparatus as in claim 1 in which the ferromagnetic pole pieces are of laminated construction.

7. An apparatus as in claim 6 in which the exposed edges of the plies of the laminated pole pieces are covered by plates made of non-ferromagnetic material.

8. An apparatus as in claim 7 in which the cover plates are made of stainless steel.

9. An apparatus as in claim 1 in which the electrical conductors are provided with ducts, through which ducts a coolant may be circulated.

10. An apparatus as in claim 2 in which the individual pole pieces are fabricated into a single plate, the pole pieces being separated from one another by non-ferromagnetic inserts.

11. An apparatus as in claim 2 in which the non-ferromagnetic inserts are made of stainless steel.

12. An apparatus as in claim 2 in which a plurality of individual pole pieces are associated with at least one of the loops, so that the pole pieces may be positioned symetrically of the mould, regardless of the disposition of the loops with respect to the mould.

13. An apparatus as in claim 1 in which each energising coil is wound about its associated electrical conductor.

14. An apparatus as in claim 1 in which the energising coils are coupled to the conductors by means of ferromagnetic cores.

15. An apparatus as in claim 1 in which the multiphase alternating current has a frequency of from 50 to 60 Hz.

16. An apparatus as in claim 1 in which the current in the conductors is of in excess of 10,000 amps at a voltage drop of about one volt.

17. A continuous casting apparatus including a mould and a stirrer as claimed in claim 1, said stirrer being positioned above the mould and being arranged to produce a magnetic field within the mould, said magnetic field rotating about the longitudinal axis of the mould.

* * * * *

UNITED STATES PATENT AND TRADEMARK OFFICE

CERTIFICATE OF CORRECTION

PATENT NO. : 4,479,531

DATED : October 30, 1984

INVENTOR(S) : Keith R. Whittington, et al

It is certified that error appears in the above-identified patent and that said Letters Patent is hereby corrected as shown below:

Item [75]:

Title page, under "Inventors" add --David A. Melford, Saffron Walden, United Kingdom--.

Signed and Sealed this

*Fourteenth* Day of *May 1985*

[SEAL]

*Attest:*

DONALD J. QUIGG

*Attesting Officer* *Acting Commissioner of Patents and Trademarks*